US009892694B2

(12) United States Patent
Fu et al.

(10) Patent No.: US 9,892,694 B2
(45) Date of Patent: Feb. 13, 2018

(54) METHOD AND SYSTEM FOR IMPROVING LUMINANCE UNIFORMITY OF 3D LIQUID CRYSTAL DISPLAY IN 3D DISPLAYING

(71) Applicant: SHENZHEN CHINA STAR OPTOELECTRONICS TECHNOLOGY CO., LTD., Shenzhen, Guangdong (CN)

(72) Inventors: Wei Fu, Guangdong (CN); Wei Chen, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 247 days.

(21) Appl. No.: 14/382,618

(22) PCT Filed: Aug. 18, 2014

(86) PCT No.: PCT/CN2014/084653
§ 371 (c)(1),
(2) Date: Sep. 3, 2014

(87) PCT Pub. No.: WO2016/019599
PCT Pub. Date: Feb. 11, 2016

(65) Prior Publication Data

US 2016/0253968 A1 Sep. 1, 2016

(30) Foreign Application Priority Data

Aug. 8, 2014 (CN) ..... 2014 1 0390974

(51) Int. Cl.

| | |
|---|---|
| ***G09G 3/34*** | (2006.01) |
| ***G09G 3/36*** | (2006.01) |
| ***G09G 3/00*** | (2006.01) |

(52) U.S. Cl.
CPC ..... *G09G 3/342* (2013.01); *G09G 3/003* (2013.01); *G09G 3/3406* (2013.01); *G09G 3/36* (2013.01);
(Continued)

(58) Field of Classification Search
CPC ..... G09G 3/342; G09G 3/003; G09G 3/36; G09G 2320/0233; G09G 2320/0626
See application file for complete search history.

(56) References Cited

U.S. PATENT DOCUMENTS

| | | | |
|---|---|---|---|
| 7,441,935 | B2 | 10/2008 | Kim |
| 9,053,672 | B2 | 6/2015 | Yasui et al. |

(Continued)

FOREIGN PATENT DOCUMENTS

| | | |
|---|---|---|
| CN | 1908748 | 2/2007 |
| CN | 101159121 | 4/2008 |

(Continued)

OTHER PUBLICATIONS

International Search Report for PCT/CN2014/084653, English translation attached to original, Both completed by the Chinese Patent Office dated Apr. 13, 2015, All together 8 Pages.

*Primary Examiner* — Ariel Balaoing
(74) *Attorney, Agent, or Firm* — Mintz Levin Cohn Ferris Glovsky and Popeo, P.C.; Kongsik Kim

(57) ABSTRACT

A method for improving luminance uniformity of a 3D liquid crystal display in 3D displaying, comprising: acquiring transmittance of each of n predetermined regions of a liquid crystal display panel, wherein n is a positive integer; adjusting original luminance of each region; and calculating luminance of backlight corresponding to each region according to the transmittance and the adjusted luminance of each region. A system for improving luminance uniformity of a 3D liquid crystal display in 3D displaying is also disclosed.
(Continued)

The system improves the luminance uniformity of the 3D liquid crystal display in 3D displaying by compensating for backlight of each of regions of the liquid crystal display panel, so that the luminance of the liquid crystal display panel in 3D displaying that is actually felt by eyes may not be un-uniform.

10 Claims, 2 Drawing Sheets

(52) U.S. Cl.
CPC ..... *G09G 2320/0233* (2013.01); *G09G 2320/0626* (2013.01); *G09G 2360/16* (2013.01)

(56) References Cited

U.S. PATENT DOCUMENTS

2003/0210256 A1* 11/2003 Mori ..... G09G 3/3233 345/690
2003/0227435 A1 12/2003 Hsieh
2005/0104839 A1* 5/2005 Baik ..... G09G 3/3406 345/102
2006/0066642 A1* 3/2006 Ookawara ..... G09G 3/006 345/690
2009/0284545 A1* 11/2009 Watanabe ..... G09G 3/3406 345/589
2011/0096105 A1 4/2011 Park et al.
2011/0128302 A1 6/2011 Cho et al.
2012/0182332 A1 7/2012 Liu
2014/0078269 A1* 3/2014 Jo ..... H04N 13/0018 348/55
2015/0145976 A1* 5/2015 Yi ..... H04N 13/0447 348/59

FOREIGN PATENT DOCUMENTS

CN 101546541 9/2009
CN 101950543 1/2011
CN 102196294 9/2011
CN 102298904 12/2011
CN 102592554 7/2012
CN 103428519 12/2013
JP 2010204161 9/2010
WO 2008096469 8/2008

* cited by examiner

METHOD AND SYSTEM FOR IMPROVING LUMINANCE UNIFORMITY OF 3D LIQUID CRYSTAL DISPLAY IN 3D DISPLAYING

CROSS-REFERENCE TO RELATED APPLICATION

This application is the U.S. national phase of PCT Application No. PCT/CN2014/084653 filed on Aug. 18, 2014, which claims priority to CN Patent Application No. 201410390974.5 filed on Aug. 8, 2014, the disclosures of which are incorporated in their entirety by reference herein.

TECHNICAL FIELD

The present invention relates to Three Dimension (3D) display technical field, and more particularly, relates to a method and a system for improving luminance uniformity of a 3D liquid crystal display in 3D displaying.

BACKGROUND ART

A 3D stereoscopic technology of a 3D stereoscopic television mainly includes a polarized (i.e. active) type and a shutter (i.e. passive) type, wherein the shutter 3D stereoscopic technology utilizes left and right switches of glasses and synchronized alternation of left and right frames of a television image to enable eyes to view different images switched in a high speed, so as to generate a stereoscopic image in a brain.

In a 3D display mode, a shutter 3D liquid crystal display may adopt an operating mode of Backlight Scanning or an operating mode of Backlight Blinking.

As is well known, a liquid crystal molecule has a response speed, and a liquid crystal display panel of the shutter 3D liquid crystal display refreshes pictures from top to bottom when it operates, so that the liquid crystal molecules in each of regions on the liquid crystal display panel do not rotate at the same time. When the liquid crystal display panel of the shutter 3D liquid crystal display performs 3D displaying, to the entire liquid crystal display panel, the glasses and the backlight are turned on at the same time, which may cause the luminance of the entire liquid crystal display panel to be actually felt un-uniform by the eyes.

SUMMARY

In order to resolve the above technical problems of the prior art, an object of the present invention is to provide a method for improving luminance uniformity of a 3D liquid crystal display in 3D displaying, comprising: acquiring transmittance of each of n predetermined regions of a liquid crystal display panel, wherein n is a positive integer; adjusting original luminance of each region; calculating luminance of backlight corresponding to each region according to the transmittance and the adjusted luminance of each region.

Furthermore, a specific method for acquiring the transmittance of each region comprises: acquiring the original luminance of each region; acquiring original luminance of the backlight corresponding to each region; calculating the transmittance of each region according to the original luminance of each region and the original luminance of the backlight corresponding to each region.

Furthermore, a specific method for calculating the transmittance of each region is that: the original luminance of each region is divided by the original luminance of the backlight corresponding to each region.

Furthermore, the adjusted luminance of the regions is the same, wherein the adjusted luminance of each region is an average value of the original luminance of the regions.

Furthermore, the luminance of the backlight corresponding to each region is calculated using Formula 3:

$$Ym'=Ym+(Xm'-Xm)/Am, \quad \text{[Formula 3]}$$

wherein Ym' denotes the calculated luminance of the backlight corresponding to an mth region; Ym denotes the original luminance of the backlight corresponding to the mth region; Xm' denotes the adjusted luminance of the mth region; Xm denotes the original luminance of the mth region; Am denotes the transmittance of the mth region; $1 \le m \le n$, and m is a positive integer.

Another object of the present invention is to provide a system for improving luminance uniformity of a 3D liquid crystal display in 3D displaying, comprising: a transmittance acquiring unit configured to acquire transmittance of each of n predetermined regions of a liquid crystal display panel, wherein n is a positive integer; a region luminance adjusting unit configured to adjust original luminance of each region; a backlight luminance calculating unit configured to calculate luminance of backlight corresponding to each region according to the transmittance and the adjusted luminance of each region.

Furthermore, the transmittance acquiring unit is further configured to acquire the original luminance of each of n predetermined regions of the liquid crystal display panel; acquire original luminance of the backlight corresponding to each region; and calculate the transmittance of each region according to the original luminance of each region and the original luminance of the backlight corresponding to each region.

Furthermore, the transmittance acquiring unit is further configured to divide the original luminance of each region by the original luminance of the backlight corresponding to each region so as to calculate the transmittance of each region.

Furthermore, the adjusted luminance of the regions is the same, wherein the adjusted luminance of each region is an average value of the original luminance of the regions.

Furthermore, the backlight luminance calculating unit is further configured to use Formula 3 to calculate the luminance of the backlight corresponding to each region:

$$Ym'=Ym+(Xm'-Xm)/Am \quad \text{[Formula 3]}$$

wherein Ym' denotes the calculated luminance of the backlight corresponding to an mth region; Ym denotes the original luminance of the backlight corresponding to the mth region; Xm' denotes the adjusted luminance of the mth region; Xm denotes the original luminance of the mth region; Am denotes the transmittance of the mth region; $1 \le m \le n$, and m is a positive integer.

The method and system for improving luminance uniformity of a 3D liquid crystal display in 3D displaying according to the present invention improves luminance uniformity of the 3D liquid crystal display in 3D displaying by compensating backlight of each of regions of the liquid crystal display panel, so that the luminance of the liquid crystal display panel in 3D displaying that is actually felt by eyes may not be un-uniform.

BRIEF DESCRIPTION OF THE DRAWINGS

Above and/or other aspects, characteristics and advantages of embodiments of the present invention will become more apparent from the following description, taken in conjunction with the accompanying drawings in which.

DETAILED DESCRIPTION OF EXEMPLARY EMBODIMENTS

Embodiments of the present invention will be described in detail below by referring to the accompany drawings. However, the present invention can be implemented in many different forms, and the present invention should not be explained to be limited hereto. Instead, these embodiments are provided for explaining the principle and actual application of the present invention, thus other skilled in the art can understand various embodiments and amendments which are suitable for specific intended applications of the present invention.

A Three Dimension (3D) liquid crystal display according to an exemplary embodiment of the present application may adopt an operating mode of Backlight Blinking, which can be switched between Two dimension (2D) displaying and 3D displaying. The 3D liquid crystal display according to the exemplary embodiment of the present application usually comprises a liquid crystal display panel and a backlight module disposed opposite to the liquid crystal display panel. Herein, the backlight module provide backlight to the liquid crystal display panel, so that the liquid crystal display panel displays images.

The liquid crystal display panel usually comprises a Thin Film Transistor (TFT) array substrate, a Color Filter (CF) substrate disposed opposite to the TFT array substrate, and a liquid crystal layer arranged between the TFT array substrate and the CF substrate, wherein the liquid crystal layer includes a plurality of liquid crystal layer molecules. Since the specific structure of the liquid crystal display panel of the present embodiment is the same as that of the liquid crystal panel of the prior art, it will not be repeated here. The backlight module comprises a light guide plate, a light source and other optical elements, wherein light emitted from the light source is irradiated into the light guide plate, and the light irradiated into the light guide plate forms an area light source after uniform diffusion, which is provided to the liquid crystal display panel. Since the specific structure of the backlight module of the present embodiment is the same as that of the backlight module of the prior art, it will not be repeated here.

Figure 1:
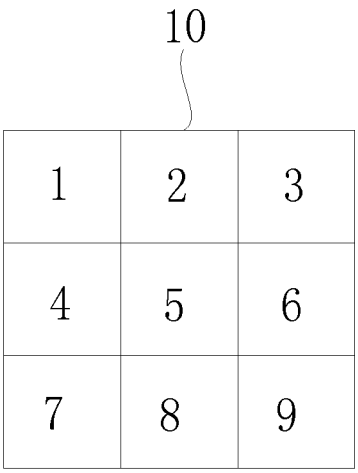
FIG. 1 is a diagram illustrating divided regions of a liquid crystal display panel, according to an exemplary embodiment of the present invention.

FIG. 1 is a diagram illustrating divided regions of a liquid crystal display panel, according to an exemplary embodiment of the present application.

Referring to FIG. 1, in the present embodiment, a liquid crystal display panel 10 according to the embodiment of the present invention is divided into nine regions, that is, region 1, region 2, region 3, region 4, region 5, region 6, region 7, region 8, and region 9, but the region division of the liquid crystal panel in the present invention is not limited to FIG. 1. In the present invention, the liquid crystal display panel may be divided into any number of regions.

Figure 2:
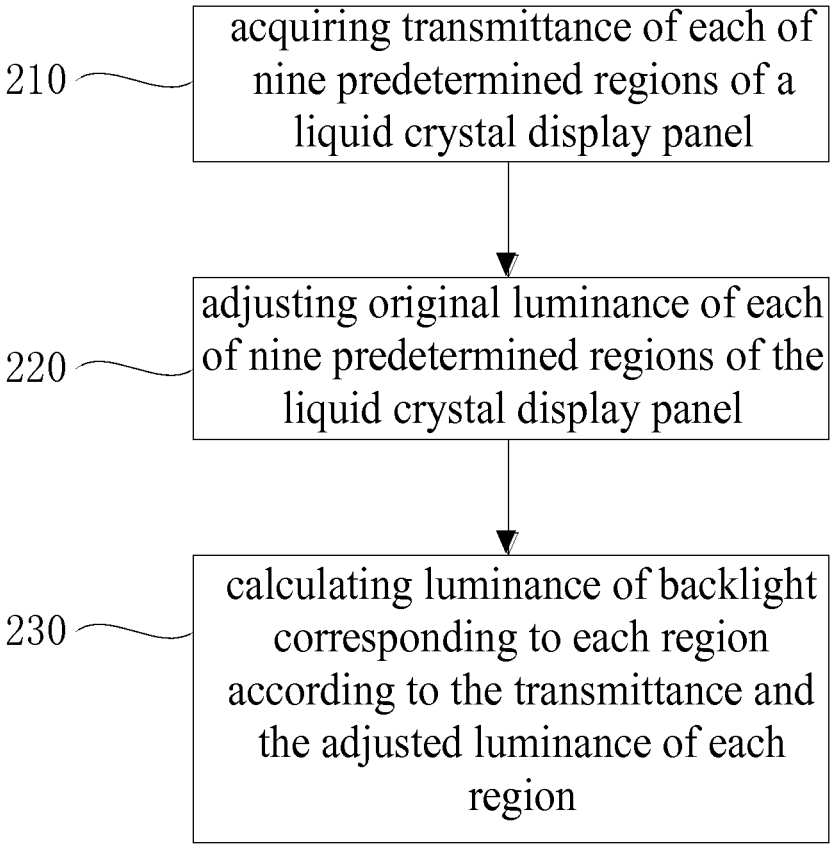
FIG. 2 is a flowchart illustrating a method for improving luminance uniformity of a 3D liquid crystal display in 3D displaying, according to an exemplary embodiment of the present invention.

FIG. 2 is a flowchart illustrating a method for improving luminance uniformity of a 3D liquid crystal display in 3D displaying, according to an exemplary embodiment of the present application.

In Step 210, transmittance of each of the nine predetermined regions of the liquid crystal display panel 10 as illustrated in FIG. 1 is acquired. In this step, a specific method for acquiring the transmittance of each region comprises: acquiring original luminance of each region; acquiring original luminance of backlight corresponding to each region; and calculating the transmittance of each region according to the original luminance of each region and the original luminance of the backlight corresponding to each region.

Here, a transmittance acquiring unit 310 (shown in FIG. 3) is used to acquire the original luminance of each region of the liquid crystal display panel 10, wherein the original luminance of an mth region is Xm, $1 \leq m \leq 9$. The transmittance acquiring unit 310 then is used to acquire the original luminance of the backlight corresponding to each region, wherein the original luminance of the backlight corresponding to the mth region is Y. Here, the backlight corresponding to each region is the backlight provided to the liquid crystal display panel 10 by the backlight module, and since the uniformity of the backlight generated by the backlight module is good, the original luminance of the backlight corresponding to each of the regions is Y, in other words, the original luminance of the backlight corresponding to the regions is the same or equal to each other. The transmittance of each region is calculated by Formula 1:

$$Am = Xm/Y \quad \text{[Formula 1]}$$

wherein Am denotes the transmittance of the mth area; Xm denotes the original luminance of the mth region, and Y denotes the original luminance of the backlight corresponding to the mth region.

In Step 220, the original luminance of each of nine predetermined regions of the liquid crystal display panel 10 as illustrated in FIG. 1 is adjusted. In this step, the original luminance of the regions is adjusted as the same luminance, in other words, the adjusted luminance of the regions is the same. The adjusted luminance of each region is calculated by Formula 2.

$$Xm' = \sum_{m=1}^{9} Xm/9 \quad \text{[Formula 2]}$$

wherein Xm' denotes the adjusted luminance of the mth area, and Xm denotes the original luminance of the mth region.

It can be seen from Formula 2 that the adjusted luminance of each region is an average value of the original luminance of the regions. This is because if the original luminance of each region is adjusted to the maximum luminance among the original luminance of the regions, it will cause the luminance of the entire backlight of the backlight module to be improved, and further cause the luminance of the liquid crystal display panel 10 to be improved even when it is in a dark state (i.e. black screen), thus, it may easily cause a phenomenon that the black screen is not black. If the original luminance of each region is adjusted to the minimum luminance among the original luminance of the regions, it will cause the luminance of the entire backlight of the backlight module to be darker, and further it may affect luminance specification of the liquid crystal display panel 10.

In Step 230, the luminance of the backlight corresponding to each region is calculated according to the transmittance and the adjusted luminance of each region. In this step, the luminance of the backlight corresponding to each region is calculated by Formula 3:

$$Ym'=Ym+(Xm'-Xm)/Am, \quad \text{[Formula 3]}$$

wherein Ym' denotes the calculated luminance of the backlight corresponding to the mth region; Ym denotes the original luminance of the backlight corresponding to the mth region; Xm' denotes the adjusted luminance of the mth region; Xm denotes the original luminance of the mth region; and Am denotes the transmittance of the mth region.

In practice, it may be realized by designing the light guide plate in the backlight module, after the luminance of the backlight corresponding to each region is determined. Different required luminance is realized by designing the density and size of the light guide points in different regions of the guide light plate, for example, if the adjusted luminance Ym' of the backlight corresponding to the mth region is greater than the original luminance Ym of the backlight corresponding to the mth region, the density and size of the light guide points of the region of the light guide plate corresponding to the mth region need to be increased; and if the adjusted luminance Ym' of the backlight corresponding to the mth region is less than the original luminance Ym of the backlight corresponding to the mth region, the density and size of the light guide points of the region of the light guide plate corresponding to the mth region need to be decreased.

In summary, the luminance uniformity of the 3D liquid crystal display 10 in 3D displaying is improved by compensating for the backlight of each of regions of the liquid crystal display panel 10, so that the luminance of the liquid crystal display panel 10 in 3D displaying that is actually felt by eyes may not be un-uniform.

Figure 3:
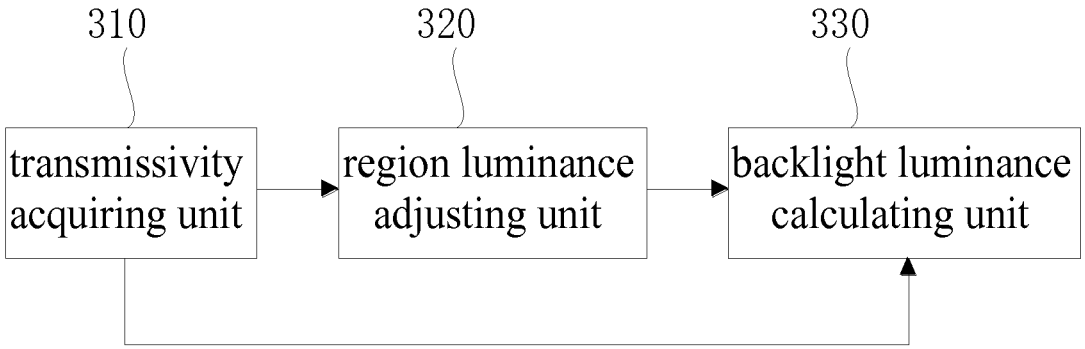
FIG. 3 is a block diagram illustrating a system for improving luminance uniformity of a 3D liquid crystal display in 3D displaying, according to an exemplary embodiment of the present invention.

FIG. 3 is a block diagram illustrating a system for improving luminance uniformity of a 3D liquid crystal display in 3D displaying according to an exemplary embodiment of the present application.

Referring to FIG. 3, the system for improving luminance uniformity of the 3D liquid crystal display in 3D displaying according to the exemplary embodiment of the present application comprises: a transmittance acquiring unit 310, a region luminance adjusting unit 320, and a backlight luminance calculating unit 330.

In particular, the transmittance acquiring unit 310 is configured to acquire transmittance of each of nine predetermined regions of the liquid crystal display panel 10 as illustrated in FIG. 1. Here, the transmittance acquiring unit 310 is further configured to acquire original luminance of each of the nine predetermined regions of the liquid crystal display panel 10 as illustrated in FIG. 1; acquire original luminance of backlight corresponding to each region; and calculate the transmittance of each region according to the original luminance of each region and the original luminance of the backlight corresponding to each region.

Here, the transmittance acquiring unit 310 is further configured to acquire the original luminance of each region of the liquid crystal display panel 10, wherein the original luminance of an mth region is Xm, $1 \leq m \leq 9$. The transmittance acquiring unit 310 then is configured to acquire the original luminance of the backlight corresponding to each region, wherein the original luminance of the backlight corresponding to the mth region is Y. Here, the backlight corresponding to each region is the backlight provided to the liquid crystal display panel 10 by the backlight module, and since the uniformity of the backlight generated by the backlight module is good, the original luminance of the backlight corresponding to each of the regions is Y, in other words, the original luminance of the backlight corresponding to the regions is the same or equal to each other. The transmittance acquiring unit 310 is further configured to calculate the transmittance of each region using the above Formula 1.

The region luminance adjusting unit 320 is configured to adjust the original luminance of each of the nine predetermined regions of the liquid crystal display panel 10 as illustrated in FIG. 1. Here, the region luminance adjusting unit 320 adjusts the original luminance of each region as the same luminance, in other words, the luminance of the regions adjusted by the region luminance adjusting unit 320 is the same. The region luminance adjusting unit 320 is further configured to calculate the adjusted luminance of each region using the above Formula 2.

The backlight luminance calculating unit 330 is configured to calculate luminance of the backlight corresponding to each region according to the transmittance and the adjusted luminance of each region. Here, the backlight luminance calculating unit 330 is further configured to calculate the luminance of the backlight corresponding to each region using the above Formula 3.

In practice, it may be realized by designing the light guide plate in the backlight module, after the backlight luminance calculating unit 330 determines the luminance of the backlight corresponding to each region. Different required luminance is realized by designing the density and size of the light guide points in different regions of the guide light plate, for example, if the adjusted luminance Ym' of the backlight corresponding to the mth region is greater than the original luminance Ym of the backlight corresponding to the mth region, the density and size of the light guide points of the region of the light guide plate corresponding to the mth region need to be increased; and if the adjusted luminance Ym' of the backlight corresponding to the mth region is less than the original luminance Ym of the backlight corresponding to the mth region, the density and size of the light guide points of the region of the light guide plate corresponding to the mth need to be decreased.

Although the present invention is described with reference to the specific exemplary embodiments, while it will be understood by those skilled in the art that various changes in form and details may be made therein without departing from the spirit and scope of the invention as defined by the appended claims and its equivalents.

What is claimed is:

1. A method for improving luminance uniformity of a 3D liquid crystal display in 3D displaying, comprising:

acquiring transmittance of each of n predetermined regions that a 3D liquid crystal display panel is divided into, by dividing original luminance of the region by original luminance of backlight corresponding to each region, wherein n is a positive integer greater than or equal to 2;

adjusting the original luminance of each of the regions;

calculating luminance of the backlight corresponding to each region according to the transmittance and the adjusted luminance of each region; and increasing one of density or size of light guide points of the region in response to the calculated luminance of the backlight of the region being greater than the original luminance of the backlight of the region.

2. The method of claim 1, wherein the adjusted luminance of the regions is the same, wherein the adjusted luminance of each region is an average value of the original luminance of the regions.

3. The method of claim 1, wherein the luminance of the backlight corresponding to each region is calculated by Formula 3:

$$Ym'=Ym+(Xm'-Xm)/Am \quad \text{[Formula 3]}$$

wherein Ym' denotes the calculated luminance of the backlight corresponding to an mth region; Ym denotes the original luminance of the backlight corresponding to the mth region; Xm' denotes the adjusted luminance of the mth region; Xm denotes the original luminance of the mth region; Am denotes the transmittance of the mth region; $1 \leq m \leq n$, and m is a positive integer.

4. A system for improving luminance uniformity of a 3D liquid crystal display in 3D displaying, comprising:

a transmittance acquiring unit configured to acquire transmittance of each of n predetermined regions of a 3D liquid crystal display panel by dividing original luminance of each of the regions by original luminance of backlight of the corresponding region, wherein n is a positive integer greater than 1;

a region luminance adjusting unit configured to adjust the original luminance of each of the regions;

a backlight luminance calculating unit configured to calculate luminance of backlight corresponding to each of the regions according to the transmittance and the adjusted luminance of each region; and a backlight unit configured to increase one of density or size of light guide points of the region in response to the calculated luminance of the backlight of the region being greater than the original luminance of the backlight of the region.

5. The system of claim 4, wherein the adjusted luminance of the regions is the same, wherein the adjusted luminance of each the regions is an average value of the original luminance of the regions.

6. The system of claim 4, wherein the backlight luminance calculating unit is further configured to use Formula 3 to calculate the luminance of the backlight corresponding to each of the regions:

$$Ym'=Ym+(Xm'-Xm)/Am \quad \text{[Formula 3]}$$

wherein Ym' denotes the calculated luminance of the backlight corresponding to an mth region; Ym denotes the original luminance of the backlight corresponding to the mth region; Xm' denotes the adjusted luminance of the mth region; Xm denotes the original luminance of the mth region; Am denotes the transmittance of the mth region; $1 \leq m \leq n$, and m is a positive integer.

7. The method of claim 1, wherein n=9.

8. The system of claim 4, wherein the n=9.

9. The method of claim 1 further comprising decreasing one of density or size of light guide points of the region in response to the calculated luminance of the backlight of the region being less than the original luminance of the backlight of the region.

10. The system of claim 4, wherein the backlight unit is further configured to decrease one of density or size of light guide points of the region in response to the calculated luminance of the backlight of the region being less than the original luminance of the backlight of the region.

* * * * *